US009718038B1

(12) United States Patent
Kellett et al.

(10) Patent No.: US 9,718,038 B1
(45) Date of Patent: Aug. 1, 2017

(54) LOOP DISSOLUTION SYSTEM

(71) Applicant: Westinghouse Electric Company LLC, Cranberry Township, PA (US)

(72) Inventors: Robert Michael Kellett, Lancashire (GB); Peter Bamber, Lancashire (GB)

(73) Assignee: Westinghouse Electric Company LLC, Cranberry Township, PA (US)

( * ) Notice: Subject to any disclaimer, the term of this patent is extended or adjusted under 35 U.S.C. 154(b) by 1091 days.

(21) Appl. No.: 14/195,875

(22) Filed: Mar. 4, 2014

(51) Int. Cl.

| | |
|---|---|
| ***B01F 5/02*** | (2006.01) |
| ***B01F 5/10*** | (2006.01) |
| ***B01F 1/00*** | (2006.01) |
| ***G21F 9/00*** | (2006.01) |

(52) U.S. Cl.
CPC ..... *B01F 5/102* (2013.01); *B01F 1/0022* (2013.01); *B01F 5/0275* (2013.01); *G21F 9/007* (2013.01)

(58) Field of Classification Search
CPC ..... B01F 5/102; B01F 5/0275; B01F 1/0022
USPC ..... 366/336, 136, 137, 340
See application file for complete search history.

(56) References Cited

U.S. PATENT DOCUMENTS 3,365,280 A * 1/1968 Heiss ..... B01F 1/0022 422/261
4,738,540 A * 4/1988 Banks ..... B01F 3/0865 366/137
5,124,035 A * 6/1992 Dunne ..... B01D 21/01 210/205
5,762,416 A * 6/1998 LeSire ..... B01F 5/043 366/136
6,241,897 B1 * 6/2001 Hanson ..... B01F 3/04248 210/614
6,305,835 B1 * 10/2001 Farrar ..... B01F 3/1271 366/162.4

(Continued)

FOREIGN PATENT DOCUMENTS

JP 2011056498 A 3/2011
JP 2012139205 A 7/2012

(Continued)

OTHER PUBLICATIONS

International Search Report and Written Opinion of the International Searching Authority for PCT/US2014/053407 dated May 28, 2015 (Forms PCT/ISA/220, PCT/ISA/210, PCT/ISA/237).

*Primary Examiner* — Tony G Soohoo
(74) *Attorney, Agent, or Firm* — Eckert Seamans Cherin & Mellott, LLC; Daniel C. Abeles

(57) ABSTRACT

A loop dissolution system specifically suited for dissolving uranium compounds in an acidic bath that continually circulates the acid over the uranium compound to be dissolved. The dissolution system includes an upper material feed dissolution plate on which the material to be dissolved is fed, a lower mixing and dissolution ring and a drop pipe system connecting and establishing fluid communication between the upper material feed dissolution plate and the lower mixing and dissolution ring. A pump for circulating the acidic fluid has an intake from the lower mixing and dissolution ring and an outlet that directs a first portion of a fluid to the upper material feed dissolution plate and a second portion of the fluid back into the lower mixing and dissolution ring to circulate the material suspended in the fluid within the lower mixing and dissolution ring to promote turbulence and facilitate dissolution.

14 Claims, 4 Drawing Sheets

(56) References Cited

U.S. PATENT DOCUMENTS

| | | | | |
|---|---|---|---|---|
| 6,619,390 | B1 * | 9/2003 | Kellett, III | B01D 45/12 166/105.1 |
| 9,334,471 | B2 * | 5/2016 | Michel | B01F 5/0212 |
| 2006/0022360 | A1 | 2/2006 | Nanjundiah et al. | |
| 2006/0291326 | A1 * | 12/2006 | Crump | B01F 5/0206 366/137 |
| 2007/0258318 | A1 * | 11/2007 | Lamon | B01F 5/0206 366/167.1 |
| 2010/0270223 | A1 * | 10/2010 | Arnaud | B01D 21/2433 210/220 |

FOREIGN PATENT DOCUMENTS

| | | | |
|---|---|---|---|
| WO | 02/062706 | A2 | 8/2002 |
| WO | WO 2015/134061 | A1 * | 9/2015 |

* cited by examiner

LOOP DISSOLUTION SYSTEM

BACKGROUND

1. Field

This invention pertains in general to chemical mixing systems and in particular a system for dissolving uranium compounds and uranic residues on a production line basis.

2. Related Art

In the processing of nuclear fuel, uranium compounds are often dissolved in an acid. At known uranium enrichments it is possible to guarantee the criticality safety of the material by restricting the geometry in which it is held. This concept is known as Safe Geometry and is the preferred method of criticality control due to its passive nature. However, the restricted dimensions employed to achieve a Safe Geometry can prove problematic when dissolving uranium compounds and uranic residues due to the high potential for blockages and difficulty in providing adequate agitation within the system in which the uranium compounds and uranic residues are dissolved.

Accordingly, a loop dissolution system is desired that can safely dissolve uranium compounds and uranic residues on a high thru put, production line basis with a substantially reduced potential for blockages with enhanced agitation.

Further, such a system is desired that accomplishes those objectives with a Safe Geometry.

SUMMARY

These and other objects are achieved by a loop dissolution system having an upper material feed dissolution plate into which a material to be dissolved is fed. The dissolution system also includes a lower mixing and dissolution ring with a drop pipe system connecting and establishing fluid communication between the upper material feed dissolution plate and the lower mixing and dissolution ring. A pump has an intake from the lower mixing and dissolution ring and an outlet that directs a first portion of the fluid employed to dissolve the material, to the upper material feed dissolution plate and a second portion of the fluid back into the lower mixing and dissolution ring to circulate the material suspended in the fluid within the lower mixing and dissolution ring to promote turbulence to facilitate dissolution. Preferably, the second portion of the fluid is directed back into the lower mixing and dissolution ring through an acceleration jet and, more preferably, the second portion of the fluid is directed back into the lower mixing and dissolution ring through a plurality of spaced inlets around the mixing and dissolution ring.

In one embodiment, the pump has a first inlet from an underside of the lower mixing and dissolution ring and a second inlet from an upper side of the lower mixing and dissolution ring with each of the first and second inlets respectively having a cutoff valve so the pump can draw the fluid alternately from the first inlet or the second inlet. Preferably, the first inlet has a vortex separation chamber in series with the pump for separating undissolved solids before the liquid enters the pump.

In another embodiment, the drop pipe system comprises a plurality of pipes respectively spaced around the upper material feed dissolution plate and respectively connected to spaced inlets around the lower mixing and dissolution ring. Preferably, the first portion of the fluid is directed to the upper material feed dissolution plate through a valved manifold compatible with different fluid distribution arrangements. In one preferred arrangement, an active level trip system is provided for determining the level of fluid in the upper material feed dissolution plate and shutting off the first portion of the fluid from entering the upper material feed dissolution plate if the level exceeds a preselected value. Desirably, shutting off the first portion of the fluid from entering the upper material feed dissolution plate permits the fluid in the upper material feed dissolution plate to drain into the drop pipe system.

In some applications, the upper material feed dissolution plate is enclosed within a fume extraction chamber with an air inlet and vacuum extraction outlet. Preferably, a flow meter is provided in the air inlet that is responsive to a preselected decrease in flow to cease the dissolution operation. The drop pipe system may also be fitted with a compressed air inlet to aid mixing and transfer of the solids into the lower mixing and dissolution ring. Preferably, the compressed air inlet is positioned adjacent a juncture of the drop pipe system and the lower mixing and dissolution ring. The system may also have a temperature controller for maintaining the temperature of the fluid within a selected range before the fluid is fed into the material feed dissolution plate.

BRIEF DESCRIPTION OF THE DRAWINGS

A further understanding of the invention claimed hereafter can be gained from the following description of the preferred embodiments when read in conjunction with the accompanying drawings in which:

DESCRIPTION OF THE PREFERRED EMBODIMENT

At known uranium enrichments it is possible to guarantee the criticality safety of such a material by restricting the geometry in which it is held. This concept is known as Safe Geometry and is the preferred method of criticality control due to its passive nature. However, the restrictive dimensions can prove problematic when dissolving uranium compounds and uranic residues due to the high potential for blockages and difficulty in providing adequate agitation within the system. Configuring a dissolver system as a high velocity loop dissolver overcomes these problems while allowing the Safe Geometry principles to be maintained.

Figure 1:
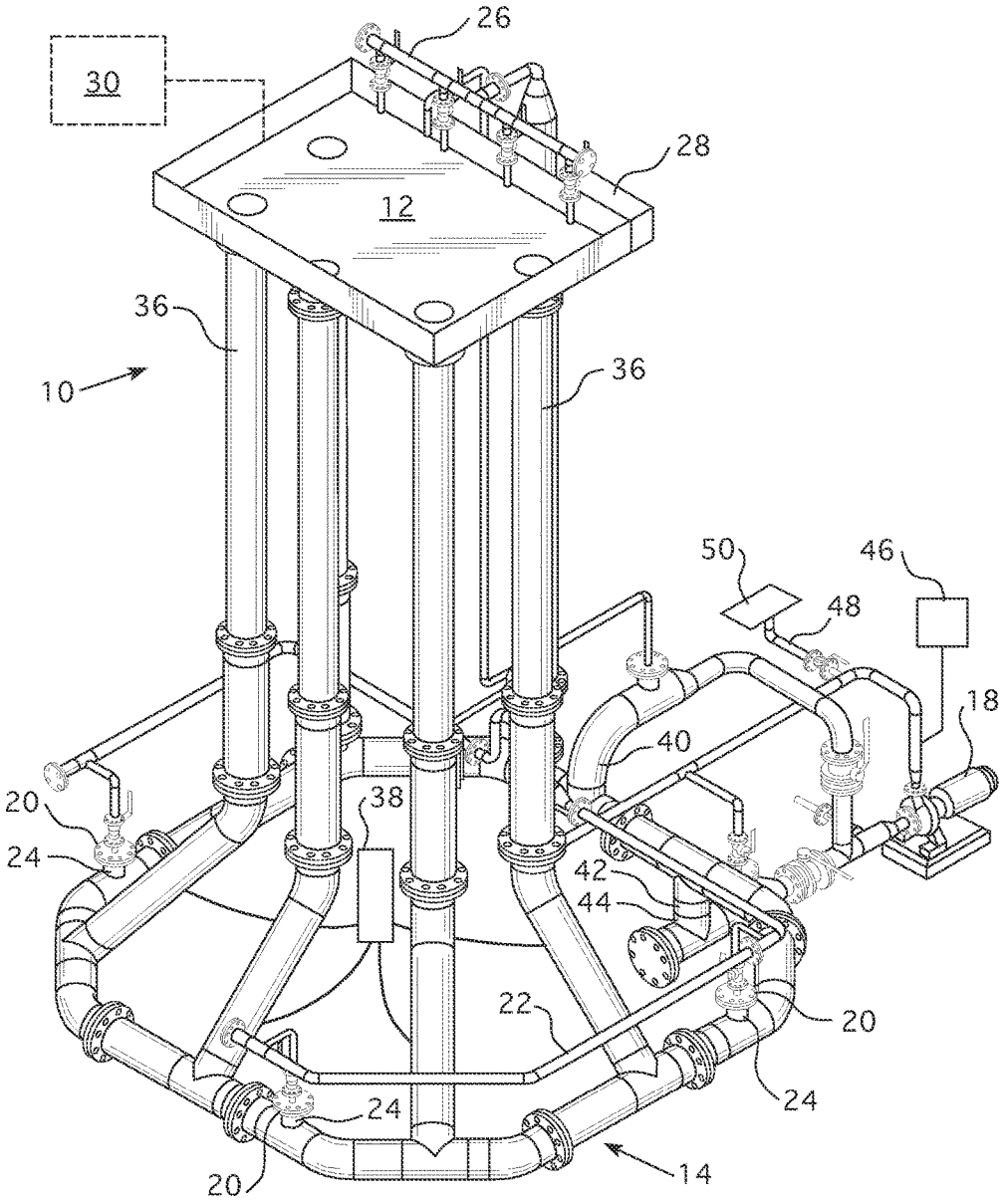
FIG. 1 is an isometric view of one embodiment of the loop dissolution system claimed hereafter.
Figure 2:
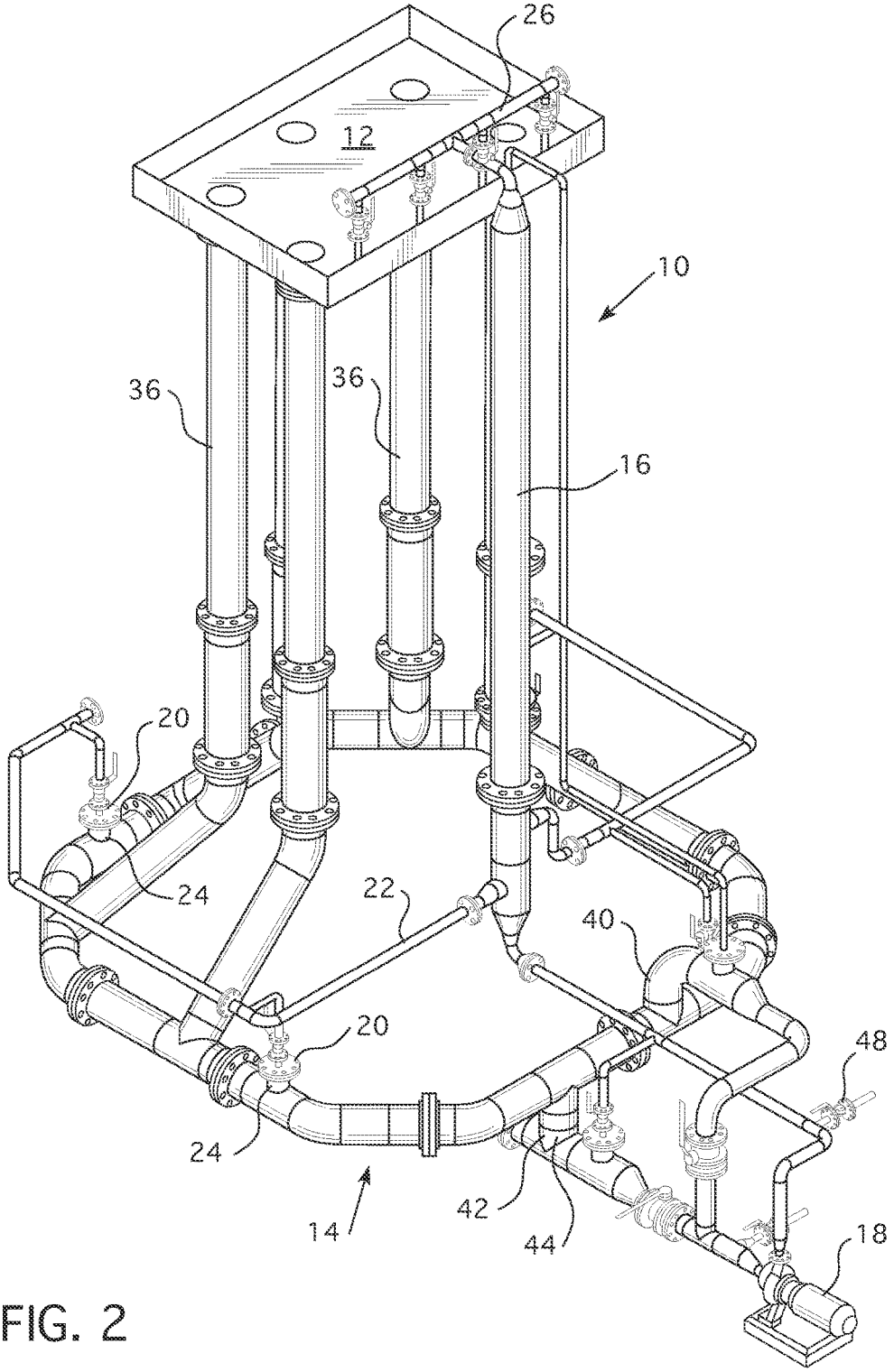
FIG. 2 is an isometric view of the loop dissolution system illustrated in FIG. 1 rotated 90°.
Figure 3:
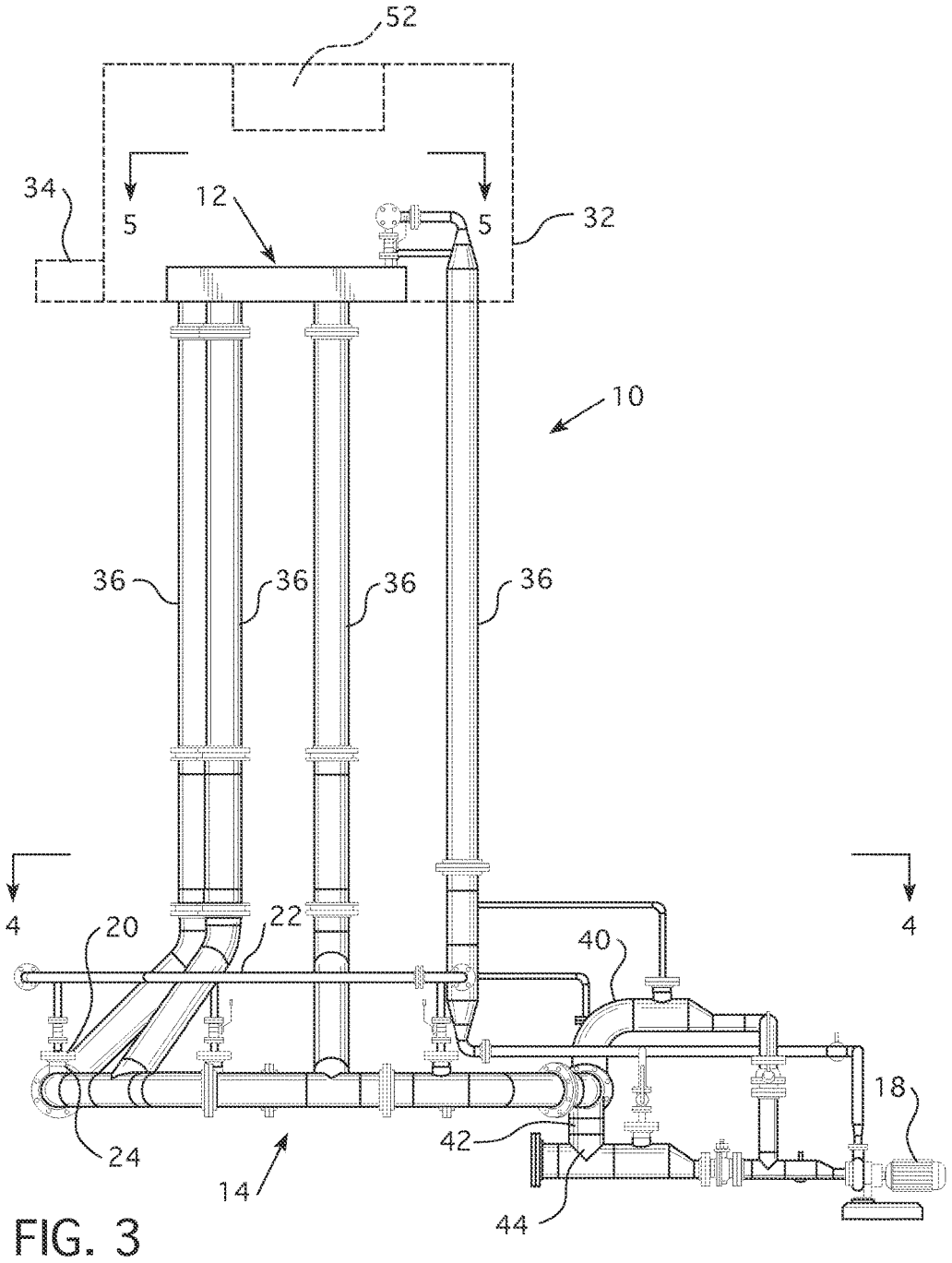
FIG. 3 is an elevation view of the loop dissolution system shown in FIGS. 1 and 2.
Figure 4:
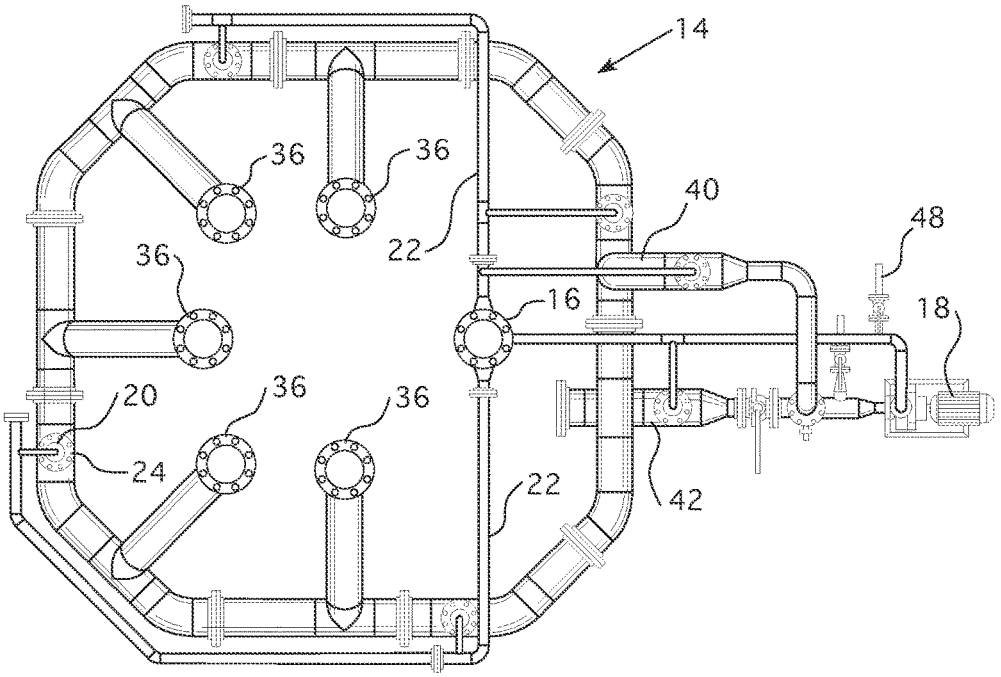
FIG. 4 is a plan, sectional view taken along the line 4-4 of FIG. 3.
Figure 5:
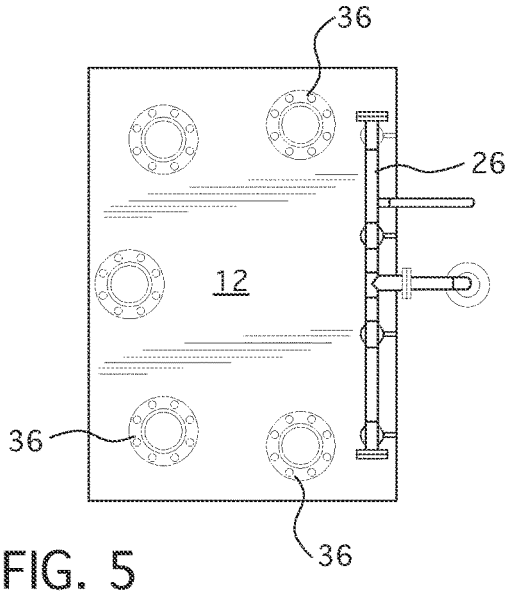
FIG. 5 is a plan, sectional view taken along the line 5-5 of FIG. 3.

One embodiment of a dissolver constructed in accordance with the principles claimed hereafter, that employs Safe Geometry dimensions for criticality safety is illustrated in FIGS. 1-5. The dissolver system 10 has two main elements, an upper dissolution plate 12 and a lower mixing and dissolution ring 14. These two main elements are configured to allow continuous circulation of an acidic solution by pumping the solution from the mixing and dissolution ring 14 through the pump 18 and conduit 16 to the upper dissolution plate 12 while a second portion is fed into acceleration jets 20 through conduit 22 and inlets 24 on the mixing and dissolution ring. This arrangement provides the necessary mixing and agitation to effectively dissolve the uranics at an increased rate while avoiding the blockage issues seen in conventional uranic feed and dissolution systems.

The upper dissolution plate 12 acts as a simple safe geometry slab into which can be installed a range of acid distribution arrangements to suit the particular characteristics of the material to be dissolved. These arrangements include, but are not limited to, fluidized beds, single and multi-chamber weirs and acid flow tubes with containment baskets. The main acid feed to the dissolution plate 12 is fed into a valve manifold 26 that allows the connection of the different acid distribution arrangements. Overflow weirs 28 (figuratively shown in FIG. 1) may be incorporated into the dissolution plate 12 to provide a passive method to prevent the Safe Geometry dimensions from being exceeded and may be supplemented with an active level trip system 30 for additional safety. The overflow weir preferably drains to a further Safe Geometry containment vessel or bund. Should an unexpected event or reaction occur on the dissolution plate 12, it can be quickly controlled by stopping the acid feed to the plate and allowing the existing acid to drain away, thereby halting the reaction.

Preferably, the upper dissolution plate 12 is enclosed within a glazed fume extraction chamber 32 (figuratively shown in FIG. 3), with fixed atmospheric inlets and vacuum extraction points to ensure all generated gases are safely extracted while simultaneously providing an air "wash" over the glazed sections to prevent chemical attack of the windows. A flow meter 34 is preferably installed in the air inlet pipe-work to inhibit dissolution operations if the fume extract is not functional. Placing the flow meter in the air inlet ensures that the instrument is not subject to damage or coating by the process gases while still effectively indicating that the extraction chamber is under negative pressure due to the extraction system being active. The extraction chamber provides a large gas buffer capable of accepting any gases released by the process without causing the system to pressurized or lose containment. The chamber 32 may be provided with glove port access, material feed routes and wash down facilities. Access to the chamber to load problematic/unusual material, change acid distribution arrangements, remove non-dissolvable solids or perform maintenance activities is through an interlocked door arrangement 52 (figuratively shown in FIG. 3) that provides direct access to the dissolution plate 12.

The lower dissolution ring 14 consists of a ring of pipe-work into which are inserted acceleration nozzles 20 that introduce jets of acid to induce motion and agitation of the material within the ring 14. Drop pipes 36 extending from the upper dissolution plate 12 enable the transfer of liquids and potentially solids into the lower mixing ring 14.

The multiple large diameter drop pipes negate the potential for blockages of the liquor route from the upper dissolution plate to the lower dissolution ring. These drop legs 36 also increase the system volume permitting larger quantities of material to be dissolved prior to reaching concentrations that will likely crystallize and can optionally be fed with compressed air (figurative shown by reference character 38 in FIG. 1) to the base of the drop pipes 36 to aid mixing and the transfer of solids into the lower ring 14. The ring 14 has both a top and bottom off take 40, 42 to the circulation pump 18, with the top off take 40 being used during dissolution to minimize solid carryover to the pump and the bottom off take 42 being used to empty the system via an in-line vortex separation chamber 44.

The pump outlet acid flow is split between conduit 22 which communicates a first portion of the fluid flow to the lower ring acceleration jets 20 and conduit 16 which communicates the acid to the upper dissolution plate 12 during normal operations and can be diverted to recirculate the system contents via a filter system to remove solids prior to final filtration and transfer for onward processing. A temperature control system 46 can be used to heat or cool the acid feed to the dissolution plate 12, and hence the overall system. Temperature control is achieved via an in-line heater/cooler arrangement on the main acid feed line 16 to the upper manifold 26. The heater is controllable and capable of achieving upwards of 80° centigrade acid temperature for effective dissolution of the uranic metals. In order to improve safety of the onward filtration process, following the dissolution period the acid temperature would be reduced to less than 30° centigrade before enabling the transfer valve 48 to the filtration system 50.

The Safe Geometry principles employed by this system are common to most enriched uranium dissolution processes, however, applying these principles in a loop dissolver configuration where acid is continually recirculated through/over the material to be dissolved is novel. In addition, the use of acid propulsion jets, vortex separation of solids, interchangeable and distribution arrangements, an ability to view the dissolution process within the extracted chamber and stop the process at any time by removing the acid from the dissolution plate are novel implementations. While this embodiment is described in connection with the dissolution of uranium compounds in an acidic fluid, it should be appreciated that it can be employed for the dissolution of any material capable of being dissolved in a fluid. This embodiment provides a high capacity enriched uranium dissolution facility capable of dealing with a wide range of feed materials from conventional powders and contaminated residues to recovered fuel pins for defabrication.

While specific embodiments of the invention have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of the invention which is to be given the full breadth of the appended claims and any and all equivalents thereof.

What is claimed is:

1. A loop dissolution system comprising:

an upper material feed dissolution plate into which a material to be dissolved is fed;

a lower mixing and dissolution ring;

a drop pipe system connecting and establishing fluid communication between the upper material feed dissolution plate and the lower mixing and dissolution ring; and a pump having an intake from the lower mixing and dissolution ring and an outlet that directs a first portion of a fluid employed to dissolve the material, to the upper material feed dissolution plate and a second portion of the fluid back into the lower mixing and dissolution ring to circulate the material suspended in the fluid within the lower mixing and dissolution ring to promote turbulence to facilitate dissolution.

2. The loop dissolution system of claim 1 wherein the second portion of the fluid is directed back into the lower mixing and dissolution ring through an acceleration jet.

3. The loop dissolution system of claim 2 wherein the second portion of the fluid is directed back into the lower mixing and dissolution ring through a plurality of spaced inlets around the mixing and dissolution ring.

4. The loop dissolution system of claim 1 wherein the pump has a first inlet from an underside of the lower mixing and dissolution ring and a second inlet from an upper side of the lower mixing and dissolution ring with each of the first and second inlets respectively having a cutoff valve so the pump can draw the fluid alternately from the first inlet or the second inlet.

5. The loop dissolution system of claim 4 wherein the first inlet has a vortex separation chamber in series with the pump.

6. The loop dissolution system of claim 1 wherein the drop pipe system comprises a plurality of pipes respectively spaced around the upper material feed dissolution plate and respectively connected to spaced inlets around the lower mixing and dissolution ring.

7. The loop dissolution system of claim 1 wherein the first portion of the fluid is directed to the upper material feed dissolution plate through a valved manifold compatible with different fluid distribution arrangements.

8. The loop dissolution system of claim 1 including an active level trip system for determining the level of fluid in the upper material feed dissolution plate and shutting off the first portion of the fluid from entering the upper material feed dissolution plate if the level exceeds a preselected value.

9. The loop dissolution system of claim 8 wherein shutting off the first portion of fluid from entering the upper material feed dissolution plate lets the fluid in the upper material feed dissolution plate drain into the drop pipe system.

10. The loop dissolution system of claim 1 wherein the upper material feed dissolution plate is enclosed within a fume extraction chamber with an air inlet and vacuum extraction outlet.

11. The loop dissolution system of claim 10 including a flow meter in the air inlet that is responsive to a preselected decrease in flow to cease dissolution operations.

12. The loop dissolution system of claim 1 wherein the drop pipe system includes a compressed air inlet to aid mixing and the transfer of solids into the lower mixing and dissolution ring.

13. The loop dissolution system of claim 12 wherein the compressed air inlet is adjacent a juncture of the drop pipe system and the lower mixing and dissolution ring.

14. The loop dissolution system of claim 1 including a temperature controller for maintaining the temperature of the fluid within a selected range before the fluid is fed to the material feed dissolution plate.

* * * * *